US008245476B2

(12) United States Patent
Sergounine

(10) Patent No.: US 8,245,476 B2
(45) Date of Patent: Aug. 21, 2012

(54) BACKBAND AND VINYL SLAT COVERING SYSTEM FOR STRUCTURES

(76) Inventor: Vladimir Sergounine, Meerbusch (DE)

( * ) Notice: Subject to any disclaimer, the term of this patent is extended or adjusted under 35 U.S.C. 154(b) by 69 days.

(21) Appl. No.: 12/928,238

(22) Filed: Dec. 7, 2010

(65) Prior Publication Data

US 2011/0277415 A1 Nov. 17, 2011

(30) Foreign Application Priority Data

May 17, 2010 (RU) ..... 2010119335

(51) Int. Cl.
*E04D 1/34* (2006.01)

(52) U.S. Cl. ..... 52/551; 52/233; 52/519; 52/526; 52/539; 52/546

(58) Field of Classification Search ..... 52/233, 52/478, 519, 521, 526, 539, 546, 547, 551, 52/783.18, 798.1
See application file for complete search history.

(56) References Cited

U.S. PATENT DOCUMENTS

| | | | | | |
|---|---|---|---|---|---|
| 1,953,460 | A * | 4/1934 | Bernhard | 52/233 |
| 2,105,280 | A * | 1/1938 | Bass | 52/831 |
| 2,829,404 | A * | 4/1958 | Wilson | 52/233 |
| 3,131,513 | A * | 5/1964 | Grigas et al. | 52/520 |
| 3,377,758 | A * | 4/1968 | Witschnig | 52/233 |
| 4,012,876 | A * | 3/1977 | Grubbs | 52/233 |
| 4,017,090 | A * | 4/1977 | Cohen | 277/644 |
| 4,134,244 | A * | 1/1979 | Sjolander | 52/506.1 |
| 4,288,954 | A * | 9/1981 | O'Donnell | 52/233 |
| 4,288,958 | A * | 9/1981 | Chalmers et al. | 52/478 |
| 4,619,089 | A * | 10/1986 | Stein | 52/233 |
| 4,930,282 | A * | 6/1990 | Meadows | 52/551 |
| 5,181,358 | A * | 1/1993 | Mead | 52/233 |
| 5,265,333 | A * | 11/1993 | Lim et al. | 29/897.32 |
| 5,271,878 | A * | 12/1993 | Mizia et al. | 264/45.5 |
| 5,423,153 | A * | 6/1995 | Woolems et al. | 52/233 |
| 5,577,357 | A | 11/1996 | Civelli | |
| 5,586,422 | A | 12/1996 | Hoffner | |
| 5,878,542 | A * | 3/1999 | Cornelius | 52/519 |
| 6,044,609 | A * | 4/2000 | Kim | 52/551 |
| 6,223,492 | B1 * | 5/2001 | Barnhart et al. | 52/551 |
| 6,363,676 | B1 * | 4/2002 | Martion, III | 52/519 |
| 6,408,580 | B1 * | 6/2002 | Jurvis et al. | 52/233 |
| 6,415,559 | B1 * | 7/2002 | Reeves et al. | 52/94 |
| D465,992 | S * | 11/2002 | Sarig | D8/354 |
| 6,647,687 | B2 | 11/2003 | Kern | |
| 2001/0017020 | A1 * | 8/2001 | Kern | 52/784.11 |
| 2003/0192282 | A1 * | 10/2003 | Bullinger et al. | 52/539 |
| 2006/0236646 | A1 * | 10/2006 | Nahmias | 52/716.1 |

* cited by examiner

*Primary Examiner* — Brian Glessner
*Assistant Examiner* — Joshua Ihezie
(74) *Attorney, Agent, or Firm* — Charles L. Thomason

(57) ABSTRACT

A system of fastening elements that attach to the building surface, including a backband with cambered support surfaces and catches, to support vinyl log siding slats with interlocking edges, and provide a log appearance to the building.

1 Claim, 4 Drawing Sheets

BACKBAND AND VINYL SLAT COVERING SYSTEM FOR STRUCTURES

This application claims the benefit of May 17, 2010 filing date in the Russian Federation bearing number 2010119305 and patent number 98023.

In summary, the invention is a system of fastening and support elements that attach to a building surface, on which vinyl slat elements with interlocking edges are supported: each fastening element being an integrally-formed, longitudinal backband, having a flat side to fit against the building surface in vertical attachment, and a support side to which the vinyl elements are placed horizontally, in interlocking arrangement; and, each backband has a slot end and a tab end, dimensioned for the tab to fit in the slot of an adjacent backband with both fastened vertically to the exterior surface of a building.

Written Description.

The elements that are combined to provide a building siding system are the backband, which is attached vertically to the outer surface of the building to be covered with siding, and the interlocking siding slats, which are supported horizontally on the backband.

In the typical install, the siding slats also are fastened to the outer surface of the building, but a key feature of the invention is for the siding slats to be supported on the backband, primarily on support ribs and by pins that catch and hold the interlocked edges of the slats.

DETAILED DESCRIPTION

Figure 1:
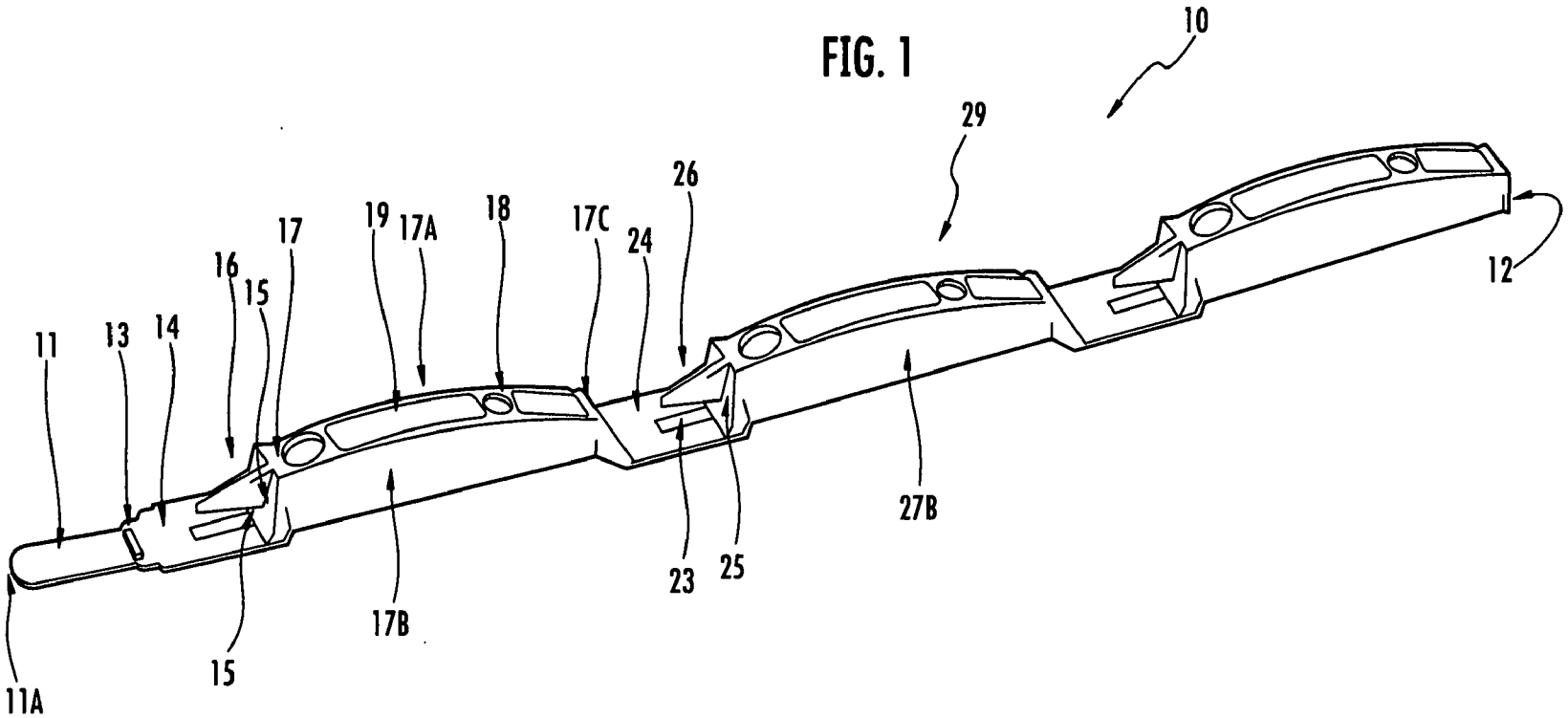
FIG. 1 depicts the backband, with a view of the front and one side.

The backband has structural features for it to be attached to, and up against, the outer surface of the building, as well as structural features to support the shape, dimension and elemental aspects of the interlocking siding slats. Also, a preferred embodiment of the backband has on opposite ends, a tab 11 and a slot 12, which provide utility for joining a vertical course of backbands.

Each backband is essentially a linear piece with planar and curvilinear features. A preferred embodiment of the backband would be integrally molded as a single piece, useful to provide support for a plurality of vinyl siding slats. To provide this utility, the backband has a generally flat side 9 that goes up against the outer surface of the building, when installed vertically. On the opposite side of the backband are the planar and curvilinear surface features that support the siding slats, and the catch features for the interlocking edges.

The essential structural features on the support side of the backband are the slot end 12, an arched cambered support surface with voids and fastener openings, a hook or catch that projects over a flat receiving surface, that flat receiving surface leading to another arched cambered support surface, and this pattern repeats to the tab end 11 of the backband 10.

The vinyl elements, resembling logs when supported, have an outward camber to fit conformingly against the arched cambered support surface on the backband. Each vinyl slat element has interlocking, longitudinal edges and attachment openings. Along one longitudinal edge is a folded, capture seam, into which the smooth inward bend of the opposite longitudinal edge of another vinyl element is captured. Below the capture seam, the vinyl element terminates with a nail strip and a longitudinal edge bended to fit beneath the catch projection and against the flat receiving surface on the backband.

For purposes of description, the backband has a flat, rear side 9, and a support, front side with the planar and curvilinear support features. When the backband is installed vertically to the building surface, the end having a tab is intended to be installed below the end with the slot. Starting at the tab 11 on one end of the backband, and continuing along its linear dimension to the slot 12 on the opposite end, the support and structural aspects of the backband 10 can be described as follows.

The tab 11, insertable in the slot 12 of another backband 10, is flat on the front side and rear side 9. The tab is generally rectangular, preferably with a rounded insertion edge 11A. It preferably has a tab stop 13 at the point between the tab and the backband. The tab stop can strengthen the connection between the tab of one backband and the slot of a second backband; the tab stop can provide a support edge when in supporting arrangement against a molded ledge formed in the slot of the second backband.

The tab and the tab stop adjoin a dimensionally flat, interlock support pad 14 on the backband. The tab and the interlock support pads 14 & 24 on the backband are co-linear, and when installed, the tab and the pads are parallel with and preferably up against the building surface. Preferably, the support pad 14 has an open portion, e.g., 23, that may receive fasteners.

Adjoining the first interlock support pad 14, at a near 90° angle, is a first interlock support ledge 15 with a catch 16 that projects therefrom and projects over the interlock support pad 14. In the preferred installation, the interlocked edges of two siding slats would be supported on the ledge and pad, and with the interlocking edge of one slat placed under the pin-shaped catch 16, as in FIG. 3. The backband, in one preferred embodiment, has three interlock support pads 14, 24 & 34, three interlock support ledges, 15. 25 & 35, each with a projecting catch, e.g., 16, 26 & 36. Other embodiments of the backband support two, three, four or five siding slats of differing widths, and the backband elements conform to provide support therefor.

Continuing along the length of the backband, which preferably is molded as a single piece, the first interlock support ledge and catch join to a log slat support surface 17 that is cambered or arcuate to conform to the shape of the slat, which resembles the part of a log that would be seen on the exterior of a log building. The arc shape of the log slat support surface 17 extends from the first interlock support ledge 15, across support edge 17A to a support edge 17C, which then extends to a second interlock support pad 24, and to a second interlock support ledge 25 with a catch 26 projecting therefrom. The pattern repeats, providing an interlock support pad, which adjoins an interlock support ledge with a catch, which adjoins a log slat support surface that n arcuately extends to a support edge, which adjoins a second interlock support pad, and so on along the length of the backband molded as a single piece.

The log slat support surface preferably has voids, typically two holes 18 to receive screws or fasteners to affix the backband to the building surface, and rectangular voids 19, 29 & 39 over open areas 8 in the backband between the front and rear sides of the backband. The voids reduce the weight of the backband and may mitigate the heat and cold temperatures around the building exterior, which can affect the shape, or deform the linearity, of the log slats supported on the arched surfaces of the backband.

Figure 2:
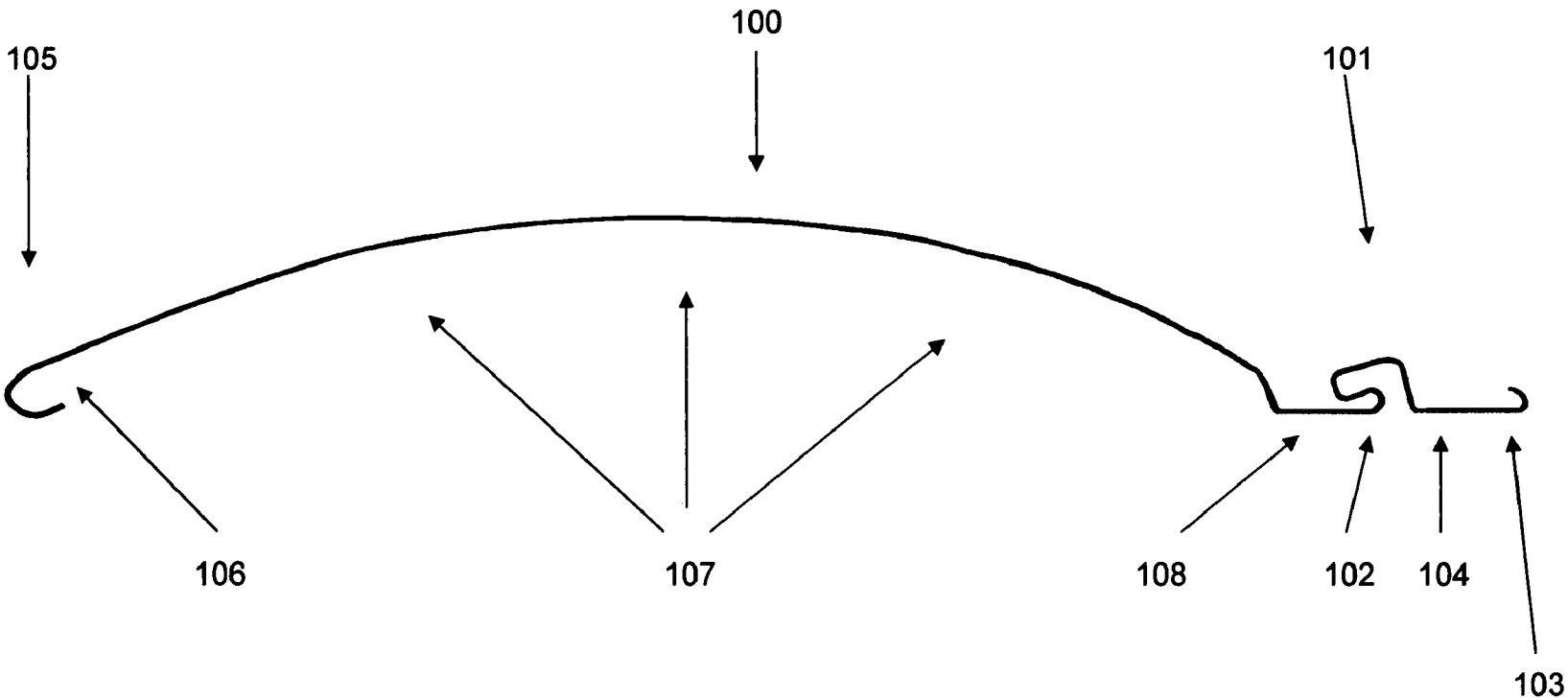
FIG. 2 depicts a siding slat in cross-sectional view.
Figure 3:
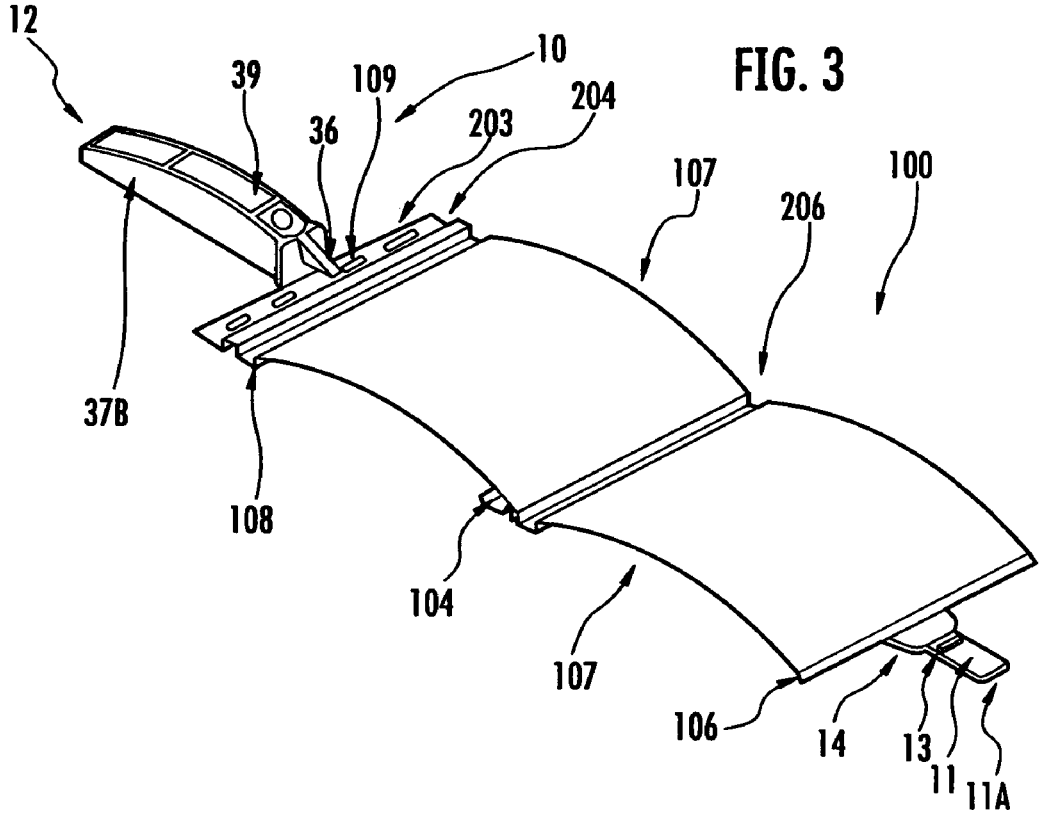
FIG. 3 depicts a backband supporting siding slats in interlocked arrangement.
Figure 4:
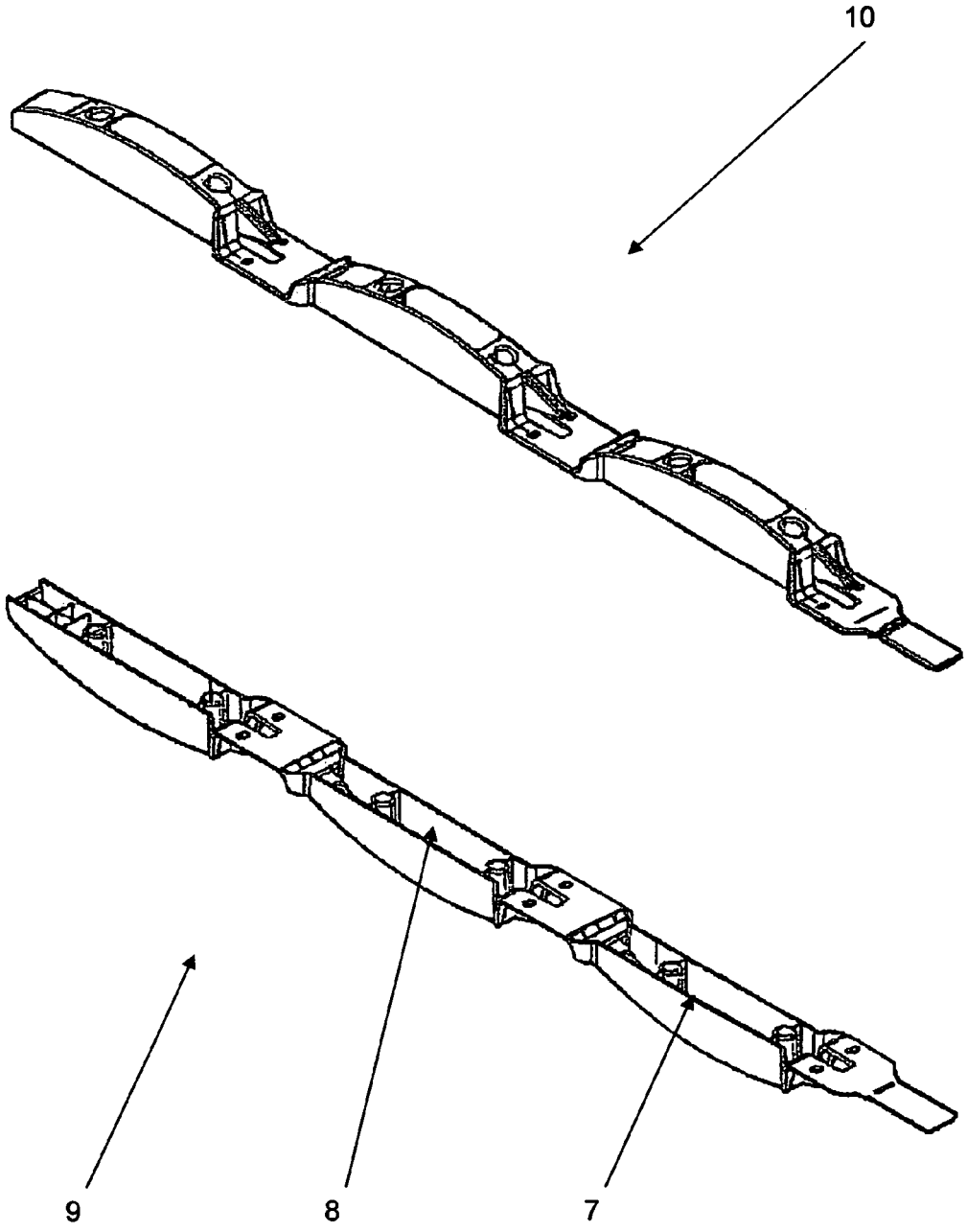
FIG. 4 depicts the front side and back side of a backband.

As shown in FIG. 2 and FIG. 3, the log siding slats 100 are linear sheet-like, cambered elements, typically of extruded vinyl, and along the length of the slats are interlocking edges, which enable the slats to be joined in interlocked relation when installed on the backband.

Described in plan view as a rectangle, each siding slat 100 terminates at essentially straight left and right edges; and, the top and bottom edges along the length of the slat have the structural features for interlocking the slats and, if desired, for securing one edge of the slat to the building surface through nailing holes. In that view of one preferred embodiment, the top edge portion 101 of the slat has a generally linear portion 104 with the nailing holes 109, a capture seam 102, next to a second linear portion 108, and at the top a securement lip 103, and that preferred embodiment of the slat has a bottom edge 105 with a folded edge 106 shaped to fit in the capture seam 202 of an adjacent slat. Described in cross-section, the interlock features along one edge are the capture seam 102 to capture the folded edge of an adjacent slat, and a curved securement lip 103 to fit under the pin-shaped catch 16 on the backband 10. Between the top and bottom interlocking edges, the siding slat in cross-section has a curved or cambered profile 107, which provides the log-like appearance for the completed installation.

The backband when described starting from the upwards end of the backband, that is, at the top end of a backband installed horizontally on a building surface, that upper end has a generally rectangular slot 12. The slot opening is integrally formed within the terminus of the backband. The walls defining the slot are, in relation to a horizontally installed backband, a left wall, a right wall 17B, and a front wall. The backband may embody a back wall to form the slot 12. From the slot opening, the left and right walls extend down in generally a linear and parallel direction along the backband. These walls have a planar edge 7 that fits flat against the building surface. Where the left and right walls merge with the front wall support surface 17, the support edge 17A is cambered to support the cambered profile 107 of the siding slats 100.

One typical embodiment of the front wall has the cambered support surface 17 and support edge 17A, one or more fastener ports, and voids 19. The fastener ports in one preferred embodiment are countersunk holes 18 through which screws are received to fasten the backband to the exterior wall surface of the building to be sided.

The camber or arch shape of the front wall 17, and of the support edges, e.g., 17A, where it joins to the left and right walls, provides support for the siding slats, which too have a cambered profile 107 when installed on the backband. The camber adds to the log-like appearance of the installed slats supported on the arched portions of the backband.

The front, left and right walls merge to a lower support plate 25, typically wider than the linear lines of left wall and right wall 27B of a support surface. The arch of the front wall support surface 27 transitions to the pin 26 or catch that projects from the lower plate 25. The lower plate merges to a flat support pad 24, which when the backband is fastened down, is flat against the building, and the pin 26 or catch projects from lower plate 25 and across the front side of the pad 24 which extends to support edge 17C.

In one preferred embodiment, the backband has a plurality of support ribs, and the flat support pad 24 has a fastener opening 23 adjacent to the catch pin 26. The lower plate is preferably wider than the left and right walls so that it provides added support surface area around the point where the siding slats interlock and fit under the catch.

The embodiments of the invention described and depicted enable the installation of the siding system to the surface of a building. Level lines for the slats and vertical lines for the backbands are established on the building surface. Then, along the vertical lines a series of backbands are secured to the building surface in parallel arrangement, with the support edges of parallel rows of the backbands being aligned horizontally on the level lines. The typical fastening is with the use of screws placed in the holes in the backband, which are driven into the building. A first siding slat is supported horizontally on a vertically attached backband, with the securement lip placed under the pin-shaped catch on the backband, and typically, with nails hammered into one or more of the nailing holes provided between the securement lip and the capture seam. Next, adjacent slat elements are placed on the supporting structures of the backband with the slat edges interlocked, then typically fastened to the building at predetermined points.

Another preferred embodiment of the invention is a lining panel kit with fastening elements as a complete article intended for outer surface lining, a lining panel as an independent part of the kit and a fastening element also as an independent part of the kit.

The complete article is characterized by the structure of the main composite elements: lining panels 100 successively attached to each other and lining fastening elements 10; provision of identical lining panels in the form of shaped articles archwise cambered outwards with relief working on the outer surface simulating wood texture and creating in the assembled condition a substitute of a log house surface; provision of the lining panels with longitudinal edges 105 and 101, one of which has a smooth bend inwards and the other passes through the projection to the sheetlike part having two linear patches, between which there is a hook-like bend 102, and the end linear patch 104 has a row of elongated holes 109 and a flanged edge 103; provision of the panel fastening elements in the form of long length backbands 10 including smoothly interfaced sheets and projections; provision of sheets being wider than projections, with chamfers and bends passing into the surface of the projections, with a square cutout 19 and two holes 18; provision of the projections being identical, hollow, formed by longitudinal, transverse and upper walls; provision of the projection upper wall of the fastening elements being archwise cambered with square windows and pits of different sizes forming in the cavity socket-type elements with the openings in the bottom 9 being interfaced with projection cavity partitions; availability on one of the transverse wall of each projection on the outside a flattened vertically oriented hook, e.g., 26 preferably in the shape of triangular prism, the upper surface of the hook being situated above the cutout 23 in the sheet being interfaced with the projection.

The lining panel 100 is characterized by the provision in the form of a shaped article being archwise cambered outwards; provision of the panel longitudinal edges, one of which has a smooth bend inwards and the other forming a step to the sheetlike part having two linear patches 103 and 108, between which there is a hook-like bend 102, and the end linear patch has a row of elongated holes 109 and an edge 103 bent outwards.

The described kit of lining panels with fastening elements as a complete article and its independent parts possess originality due to provision of the shape of the panels simulating wood texture and creating in the assembled condition a substitute of a log but surface.

The preferred embodiment of invention is the combination of the log-like, vinyl siding panels with interlocking edges and the vertical attachment system using the backband. Persons skilled in the art will understand that variations of the inventive combination and system can be made that are within the scope of this disclosure.

The invention and the foregoing described combinations being claimed are:

1. A building covering system of cambered slats on a backband, comprising:

a plurality of support ribs, joined between support pads on a backband to support one or more siding slats having interlocking edges, said backband integrally formed, with a slot at one linear end and a tab at the other end, and said support ribs and said support pads alternatively arrayed on said backband, said backband comprised of an insertion tab with planar front portion and rear portion extending to a first support pad joined to a first support rib, said first support rib having a lower wall, upper wall, left and right side walls, joined to a front support wall having a cambered support surface and at least one fastener receiver, said cambered support surface extending onto a projection from said lower wall that projects over said first support pad; a second support pad joined to said upper wall of said first support rib and extending to a lower wall with projection on a second support rib, with said second support rib having an upper wall, left and right side walls joined to a front support wall having a cambered support surface and at least one fastener receiver, said plurality of support ribs terminating with an upper wall having a slot dimensioned to receive an insertion tab; and, at least one siding slat having left and right edges, and along the length of said siding slat an upper edge with fastener openings and a capture seam, and a lower folded edge, said siding slat having a predetermined camber from said lower folded edge to below said fastener openings on said upper edge determined to be complementary with said cambered support surface on said support ribs.

* * * * *